United States Patent [19]

Scherrer

[11] 4,278,362

[45] Jul. 14, 1981

[54] METHOD FOR LIFTING AN IMMERSED DEVICE AND RETURNING IT INTO POSITION, AND FOR CARRYING OUT SAID METHOD

[75] Inventor: Norbert Scherrer, St. Just, France

[73] Assignee: Societe Europeenne de Propulsion, Puteaux, France

[21] Appl. No.: 18,058

[22] Filed: Mar. 6, 1979

[30] Foreign Application Priority Data

Mar. 10, 1978 [FR] France ..... 78 07048

[51] Int. Cl.[3] ..... B63C 11/00

[52] U.S. Cl. ..... 405/191; 114/326; 166/339; 166/362

[58] Field of Search ..... 405/185, 188, 190, 191, 405/195, 224; 9/8 P, 9; 29/402.01, 402.03; 114/326, 51; 166/339, 362

[56] References Cited

U.S. PATENT DOCUMENTS

| | | | |
|---|---|---|---|
| 3,293,867 | 12/1966 | Dean | 114/326 X |
| 3,302,709 | 2/1967 | Postlewaite | 166/362 X |
| 3,308,881 | 3/1967 | Chan et al. | 166/339 X |
| 3,709,291 | 1/1973 | Hanes et al. | 405/191 |
| 3,874,013 | 4/1975 | Hudson | 9/9 |
| 3,967,460 | 7/1976 | Cassity | 405/191 |

FOREIGN PATENT DOCUMENTS 988245 4/1965 United Kingdom .

*Primary Examiner*—David H. Corbin
*Attorney, Agent, or Firm*—Lewis H. Eslinger

[57] ABSTRACT

The present invention relates to a method for lifting an immersed device and returning it into position, and to a device for carrying out the method, wherein the device to be lifted up is provided with a locating buoy and a wound up guide line whose ends are connected to the buoy and to a locking member connected to the base on which the immersed device is mounted; the buoy is released, taking with it the guide line, along which the device is raised. The device to be replaced in position is provided with a new buoy, guide line and locking member and is lowered along the first mentioned guide line, which is severed after the device to be replaced in position has returned to the base. The method is applicable for example to lifting and replacing a remote-control pod for an underwater well head.

16 Claims, 16 Drawing Figures

METHOD FOR LIFTING AN IMMERSED DEVICE AND RETURNING IT INTO POSITION, AND FOR CARRYING OUT SAID METHOD

The present invention relates to a method for lifting an immersed device and returning it into position.

The maintenance of immersed devices, particularly underwater devices located at average depth, obviously raises particular problems of locating the device to be checked, of lifting it, of repairing or changing it and of lowering the device to be returned into position.

A known method consists in the establishment, by divers, of guide lines with or without locating buoy. The device to be lifted, then the device to be returned into position are guided between the sea-bed and the surface along the guide lines. The main drawback of this device is that is requires human intervention. Furthermore, after the new device has been placed in position, the guide lines previously established may constitute an obstacle to navigation and their removal necessitates a fresh intervention by divers.

Another known process consists in using a boat or a semi-submarine with dynamic positioning and equipped with equipment for drawing alongside the underwater device. Such a method requires a heavy substructure on the surface.

Furthermore, with each of these two known methods, the picking up of the immersed device then the return thereof into position are generally effected by means of tools mounted at the end of drilling rods, this rendering these operations long and expensive.

It is an object of the present invention to provide a method allowing immersed devices, particularly underwater ones, to be lifted up and returned into position, without calling upon human intervention on the sea-bed and without requiring a heavy substructure on the surface.

This purpose is attained by a method for lifting and returning into position at least one immersed device mounted on a base and equipped with a locating buoy and a guide line wound or folded on itself and connected at one end to the buoy and at its other end to a locking member connected to the base, according to which method, in accordance with the invention, the buoy is released to cause it to rise to the surface and establish the guide line between the base and the surface, a lifting tool is lowered along the guide line, the immersed device is separated from the base and from the locking member and raised to the surface, by means of the lifting tool, the device to be returned into position is provided with a fresh buoy, a new locking member and a new guide line connecting them, the device to be returned into position on the base is lowered along the established guide line, the new locking member is connected to the base, and the previously established guide line is severed.

At the end of these operations, an immersed device is therefore located on the sea-bed to which the method according to the invention may again be applied in identical manner, without requiring human intervention.

The device to be returned into position is advantageously lowered by the introduction of the guide line through a passage provided in this device and the new locking member. The previously established guide line may be severed by severing means actuated when the device to be returned into immersed position is connected to the base. The severing means may be constituted by cutters carried by said new locking member and actuated when said new locking member is locked on the base. The severing of the previously established guide line and the separation of the base from the locking member left in place are then effected simultaneously, and the new locking member is positioned at the spot left free by said latter.

According to another embodiment of the invention, the severing of the previously established guide line is performed after verification of the working of the device which has been immersed. The severing operation is carried out by means of cutters or similar elements which are remote controlled from the surface.

The device is preferably lifted and returned to position by means of tools displaced by means of a winch provided on the surface. These tools comprise hooking means adapted to be locked on the device, or unlocked from the device, automatically, for example tools with mechanical, electromechanical, hydraulic or electrohydraulic locking or unlocking.

The invention also relates to a device for carrying out the method, said device adapted to be immersed and mounted on an underwater base with a locating buoy and a guide line connected at a first end to the buoy and at its second end to the base and comprising means for connection to the base and a passage for guiding the device along a guide line.

According to the invention, the device itself comprises the locating buoy, the guide line folded or wound on itself with its first end connected to the buoy and its second end connected to a locking member adapted to be connected to the base and to be separated from the rest of the device, connecting means which connect the buoy to the base so as to allow separation thereof by remote control, and severing means disposed in said passage.

The invention will be more readily understood on reading the following description with reference to the accompanying drawings, in which.

Figure 1:
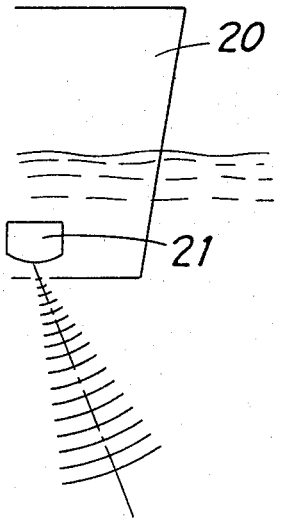
FIGS. 1 to 9 are schematic views illustrating successive phases of the method of lifting and returning into position, according to the invention.
Figure 1:
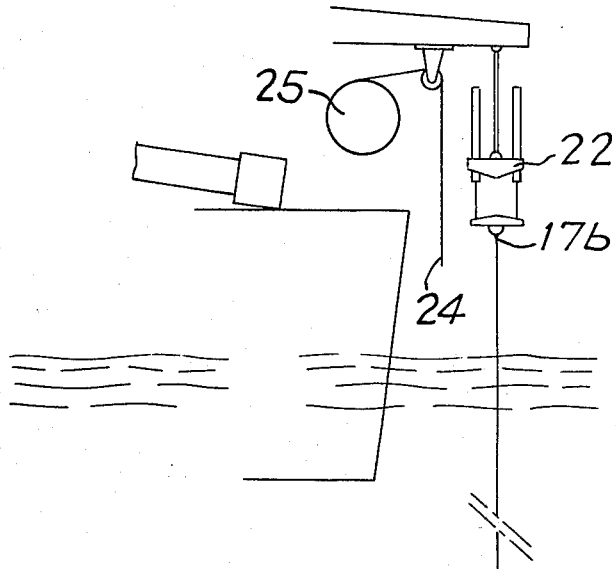
Figure 1:
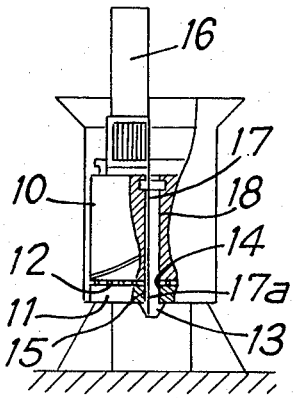

Referring now to the drawings, reference 10 in FIG. 1 designates a device immersed at average depth and mounted on a fixed base 11 resting, by feet, on the sea-bed.

The present invention is applicable to numerous devices and apparatus remaining underwater and having to be brought back to the surface for maintenance, repair or replacement.

By way of example, it will be assumed that the apparatus 10 is a remote control pod for an underwater well head which has to be returned to the surface to be replaced.

The apparatus 10 is connected to the base 11 by connectors 12 and by a locking member 13 fitted at the end of a hollow rod 14 which passes through a passage 15 formed in the base 11.

A locating buoy 16 is mounted on the apparatus 10 and is fixed to one end of a cable 17 wound on itself and having its other end fixed to the locking member 13. The end part 17*a* of the cable 17, extending between the member 13 and the buoy 16 on which the rest of the cable is wound, is housed in a substantially vertical, central passage 18 which passes through the apparatus 10 and which is materialised, at least in its lower part, by rod 14.

The buoy 16 is connected to the apparatus 10 by fixing means of which the opening, with a view to releasing the buoy, is remote-controlled, for example by means of a coded acoustic signal, or other signal, for example a hydraulic signal sent to the remote control pod.

In the example illustrated, the buoy 16 carrying the wound cable 17 is disposed on one side of the top surface of the apparatus 10, leaving the top opening of the passage 18 free. If the size of the buoy 16 is such that said buoy occupies a larger part of the upper face of the apparatus, this buoy will present a vertical passage upwardly extending the passage 18 in order to allow the vertical slide of the apparatus-buoy assembly along a vertical guide line passing through the passage 18, as explained hereinafter in the case of depositing an apparatus on the sea bed.

The apparatus 10 is lifted and replaced as follows (FIGS. 1 to 9).

The buoy is released by any suitable means, for example by a transmitter 21 mounted on a light boat 20 directing a coded acoustic signal towards the sea-bed (FIG. 1).

Figure 2:
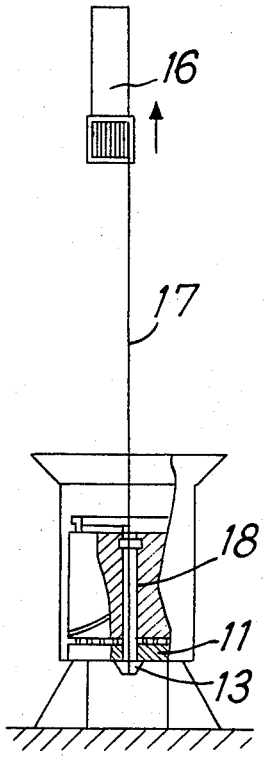

When this buoy 16 is released, it rises towards the surface, causing the cable 17 to unwind (FIG. 2).

Figure 3:
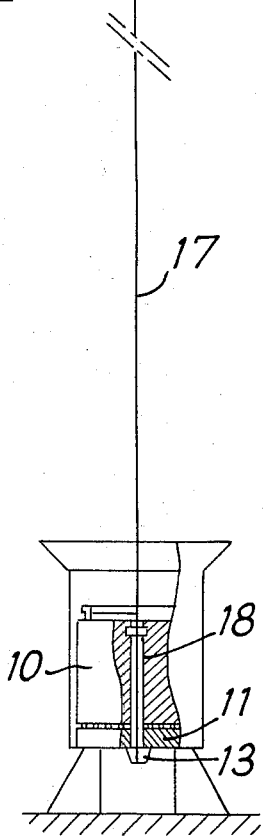

The buoy 16 having reached the surface, the end 17*b* of the cable 17 connected to this buoy is rigidly fixed to a compensator 22 carried by the boat 20 (FIG. 3). The cable 17 which then extends from the base 11 to the surface constitutes a guide line.

Figure 4:
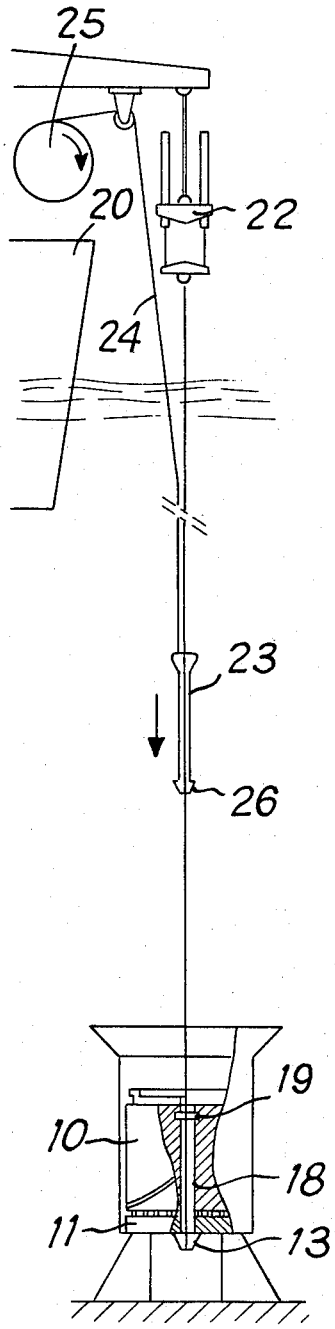

A lifting tool 23 is fixed to one end of a cable 24 of which the other end is wound on the drum of a winch 25 located on the boat 20. The tool 23 is lowered, guided along the guide line 17 (FIG. 4).

Figure 5:
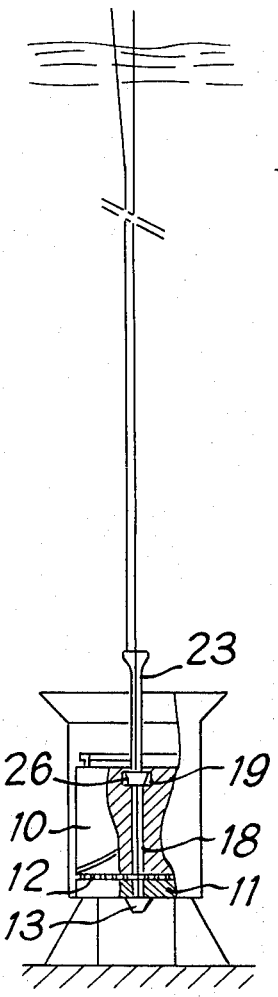

In the example illustrated, the tool 23 is in the form of a tube threaded on the guide line 17 and provided at its lower part with means for being automatically fastened on the apparatus 10, for example a bolt 26 which clips in a groove 19 in the passage 18 when the lower end of the tool 23 penetrates into this passage (FIG. 5).

Figure 6:
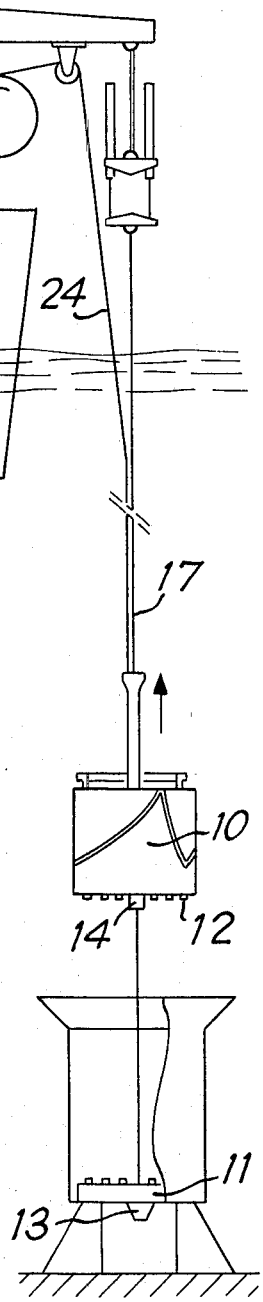

By pulling on the cable 24 and the tool 23, by means of the winch 25, the apparatus 10 is disconnected from the base 11 and this apparatus is separated from the locking member 13 since the upward movement of said latter is prevented by the base and since said member 13 is simply fitted on the lower end of the rod 14. The apparatus 10 may then be brought up to the surface (FIG. 6).

Figure 7:
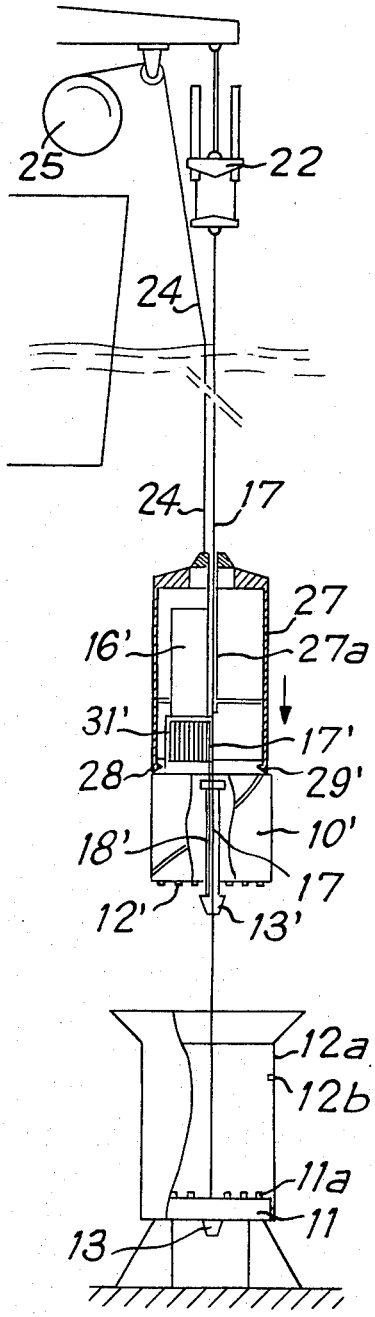

A new apparatus 10', identical to apparatus 10, is returned into position, guided from the surface along the guide line 17, said latter being introduced through the passage 18' of the apparatus 10'. The apparatus 10' is suspended from a depositing tool 27 which is fixed to the free end of the cable 24 (FIG. 7).

In the example illustrated (FIGS. 7 to 10), the tool 27 is in the form of an upturned U provided at its lower ends with hooks 28 engaged in housings provided on the periphery of the upper part of the apparatus 10'. These housings may simply be constituted by an annular groove 29'. The tool 27 has a central tubular part 27*a* threaded on the guide line 17.

The apparatus 10' (cf. in particular FIG. 10) is provided, like apparatus 10 initially, with a locating buoy 16' fixed on the upper part of the apparatus 10' so as to be able, if necessary, to be freely separated from this apparatus. The buoy 16' is connected to apparatus 10' by fixing means with opening remotely controlled by coded acoustic signal or other signal.

A cable 17' is wound on a drum 31' carried by the buoy 16', one end of the cable 17' being fixed to this buoy and the other being fixed, passing through the passage 18', to a locking member 13'. Said latter is fitted to the lower end of a hollow rod 14' which constitutes at least the lower part of the passage 18', under the apparatus 10'.

Figure 10:
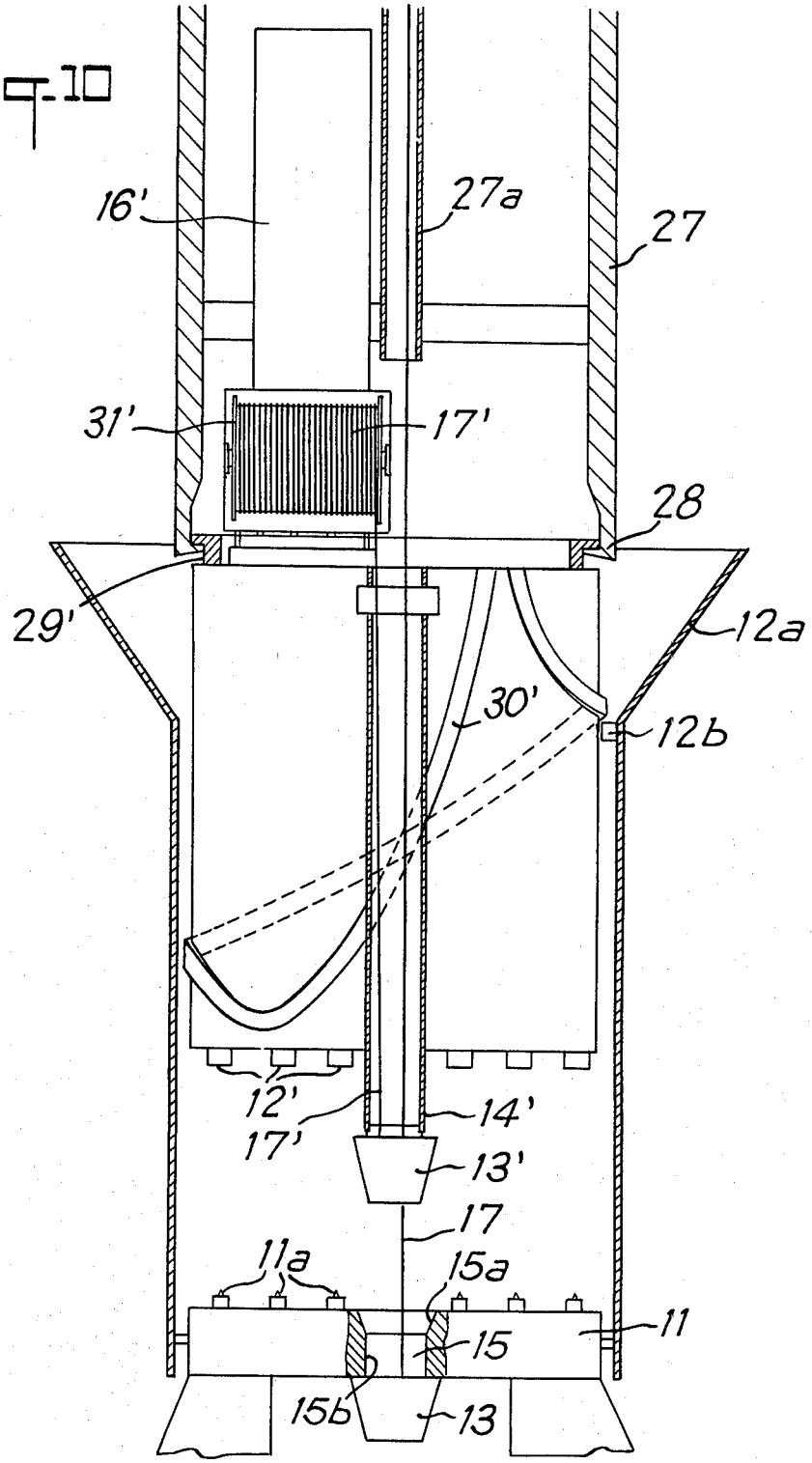
FIG. 10 is an elevational view of the device according to the invention, suspended on the depositing tool.

As is particularly visible from FIG. 10, the base 11 comprises connectors 11*a* adapted to be assembled with those 12' of the apparatus 10' and is surmounted by a cylindrical guiding envelope 12*a* which closely surrounds the location of the apparatus 10' and is widened at the top.

Figure 8:
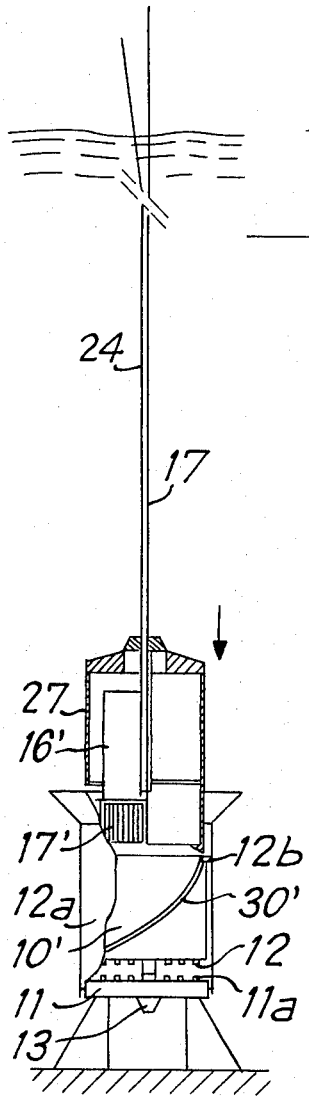

An inwardly projecting dog 12*b* is fixed to the inner wall of the envelope 12*a*, and cooperates with a helical guide rib 30' formed on the peripheral surface of the apparatus 10' to orient said latter angularly with respect to the base 11 when the apparatus 10' penetrates in the envelope 12' (FIGS. 8 and 10). The connectors 11*a* and 12*a* are thus brought opposite one another to ensure the correct connection between the base 11 and the apparatus 10'.

It will be noted that the existence of the envelope 12*a* forming guide and closely surrounding the apparatus 10' ensures an efficient damping of the movement of the apparatus 10' to brake its descent when it arrives on the base and when the connectors 11*a* and 12' are connected. The descending movement of the apparatus 10' is then governed by the escape of the water between its outer wall and the envelope 12*a*.

As will be explained in greater detail hereinafter, the depositing of the apparatus 10' on the base 11 is accompanied or is followed by the severing of the guide line 17 in its lower part. The locking member 13', after having passed through the passage 15 is locked in turn, beneath the base at the location of the locking member 13. After severing of the guide line 17, the locking member 13 drops from the base, said latter being slightly raised with respect to the sea-bed.

Figure 9:
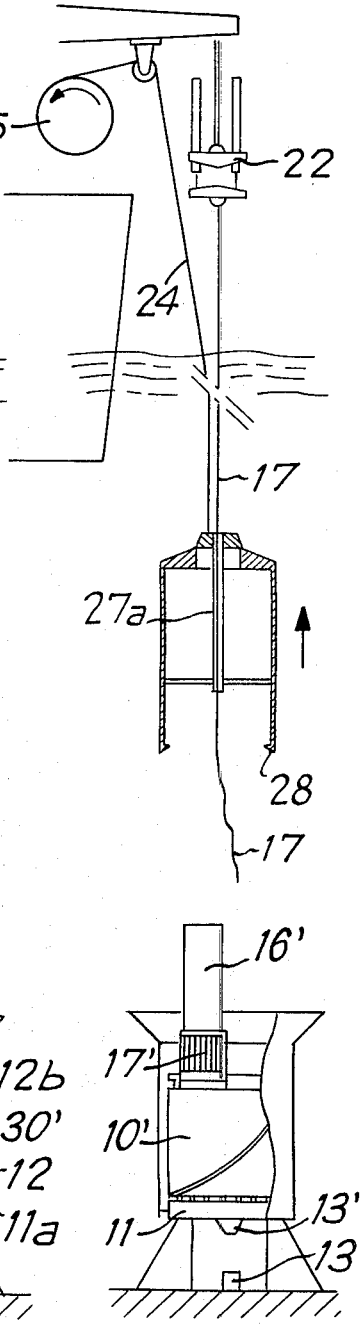

The apparatus 10' being in place, the hooks or fingers 28 of the depositing tool are unlocked automatically, for example mechanically, and the tool 27 is brought up to the surface (FIG. 9). The severed guide line 17 may then be recovered at the surface.

The conditions are then exactly the same as initially and the apparatus 10' may be lifted and replaced by proceeding exactly as described hereinbefore for apparatus 10.

An embodiment of the severing of the guide line 17 and locking of the member 13' is described in greater detail hereinafter with reference to FIGS. 11 to 14.

The member 13', whose structure is identical to that of member 13, is constituted by two shells 32', 33' connected together by rigid cross-pieces 34'. The two shells 32' and 33' are maintained in spaced apart relationship by springs 35' threaded on the crosspieces 34' and abutting on members 36' fixed to the shells 32', 33' and fitted at the ends of the crosspieces (cf. FIG. 11). The shells 32' and 33' are brought closer to each other by compression of the springs 35' and sliding on the crosspieces 34'.

The end 17'*a* of the cable 17' is constituted by a loop fitted on a rod 37' which extends between the shells 32' and 33' and on which these shells may slide when they move closer to each other. The rod 37' is offset laterally with respect to the path of the guide line 17 through member 13' (FIG. 12).

The guide line 17 passes between the shells 32' and 33' and said latter are provided with cutting jaws 38' located on either side of the guide line.

Guides 39' and 40' are provided respectively in the upper part and in the lower part of the member 13' to avoid any interference between the line 17 and the cable 17' on their common paths in the passage 18'. The guide 39' also forms a connection between the member 13' and the hollow rod 14'.

Figure 11:
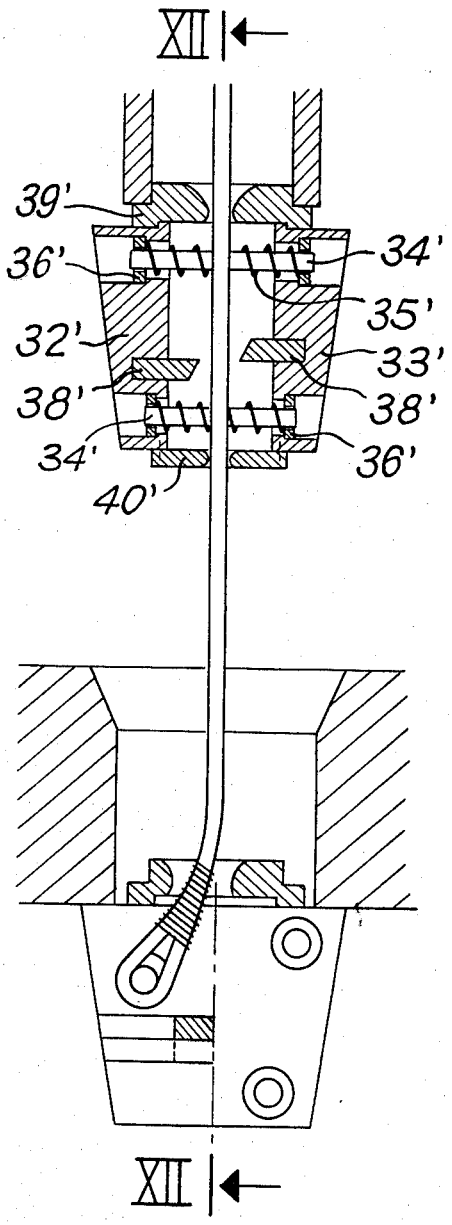
FIG. 11 is a partial view in elevation and in median longitudinal section along line XI—XI of FIG. 12, illustrating the locking member and the means for severing the device to be returned to position and a part of the base on which the device is to be deposited.
Figure 12:
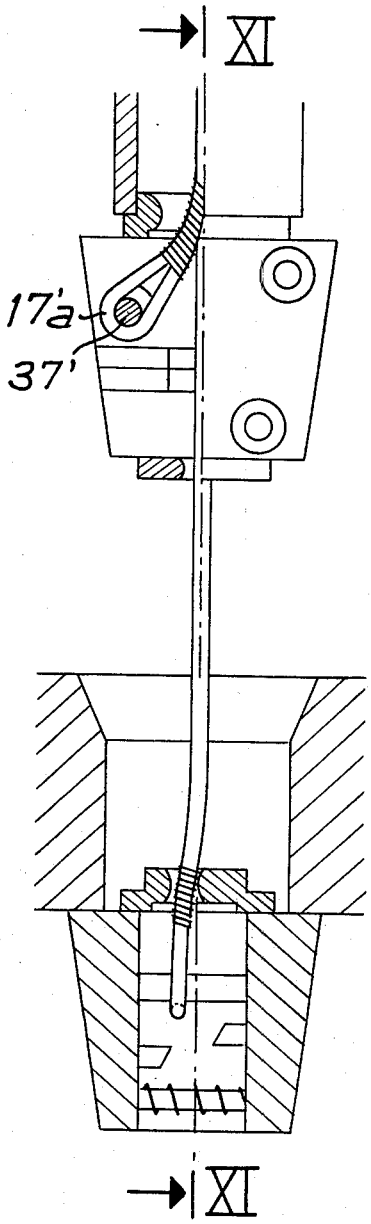
FIG. 12 is a view in partial section along line XII—XII of FIG. 11.
Figure 14:
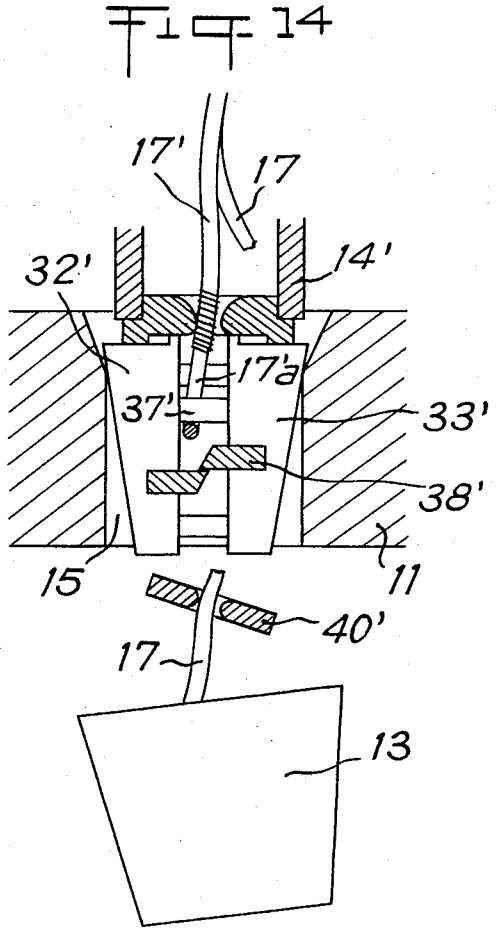
FIGS. 13 and 14 are partial front and rear views in median longitudinal section illustrating the severing of the guide line and the connection of the locking member to the base.
Figure 13:
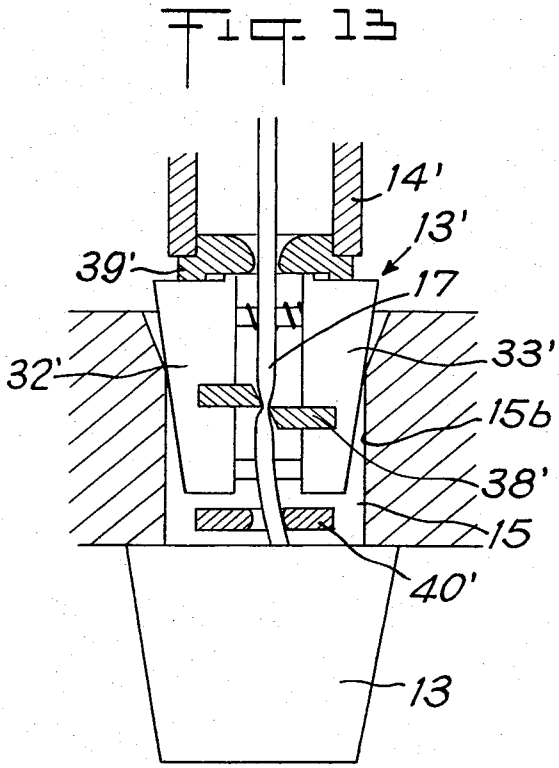

It will be noted in FIGS. 11 and 12 that the members 13' and 13 are identical in their structure but are shown offset by 90° with respect to each other about the guide line 17.

The severing of the guide line 17 is provoked by bringing the shells 32' and 33', and consequently the jaws 38' which they carry, closer together.

This bringing together is effected when the member 13' passes through the passage 15 of the base (FIG. 13), said passage having an upwardly flared top part 15*a* for guiding the member 13' and extending downwardly in a cylindrical lower part 15*b*.

The shells 32' and 33' have an upwardly widening outer form so as to provoke their coming together as they descend in the cylindrical passage 15*b*.

The bringing together of the shells 32' and 33' is effected so as to provoke the severing of the guide line 17 by the jaws 38' moving towards each other, before the member 13' leaves the passage 15.

The severing of the guide line 17 is accompanied by the drop of the member 13 and guide 40' (FIG. 14) leaving, under the base 11, room for member 13', the locking of said latter being provoked by the spacing apart of the shells 32' and 33' once they have left the passage 15.

Figure 15:
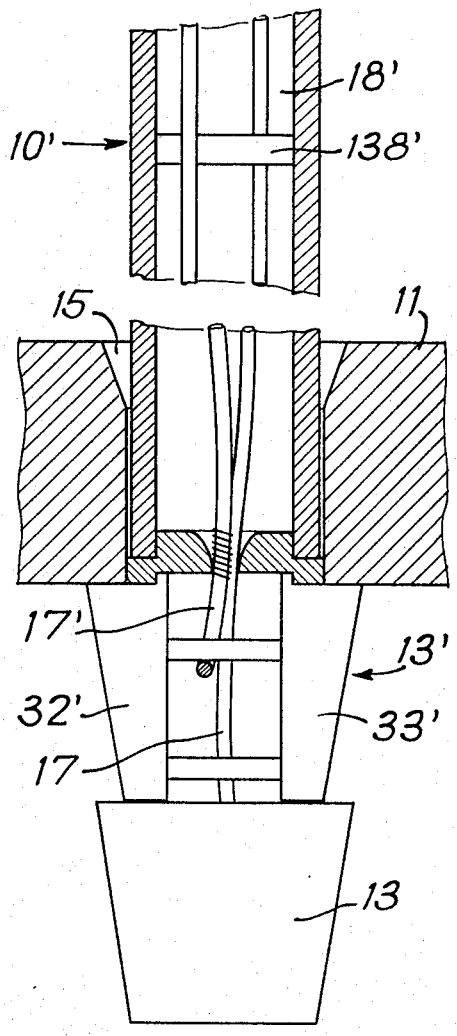
FIGS. 15 and 16 are partial rear views in median longitudinal section illustrating an embodiment of the severing of the guide line.
Figure 16:
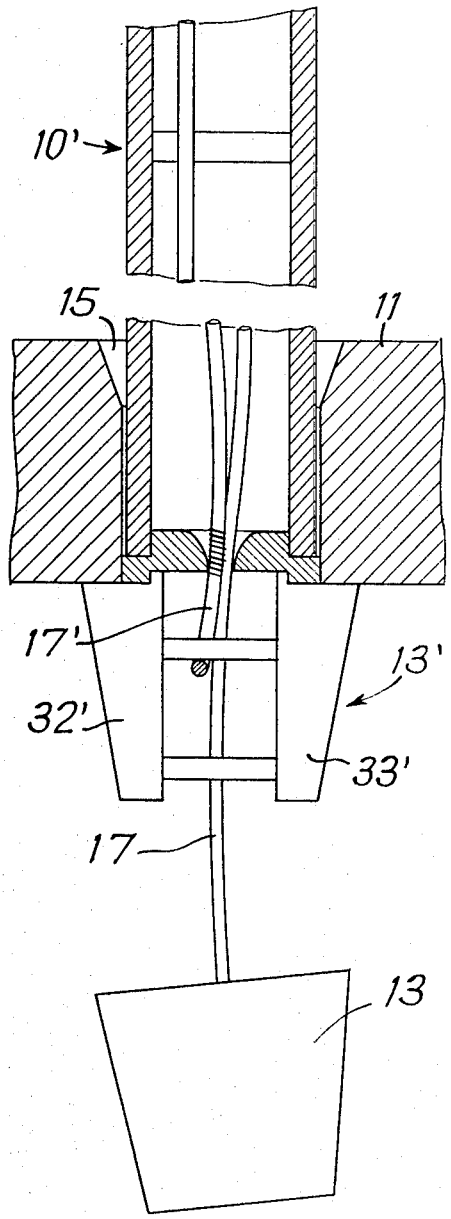

Another embodiment of the connection of the apparatus 10' with the base and of the severing of the guide line 17 is described hereinafter with reference to FIGS. 15 and 16.

Contrary to the device shown by FIGS. 11 to 14, the shells 32' and 33' are not provided with cutters.

The connection with the base is not then accompanied by the severing of the guide line 17. After having passed through the passage 15, the locking member 13' pushes down the locking member 13 and sets under the place at the location of member 13. (FIG. 15).

The working of the apparatus may be verified from above the surface by remotely controlling various operations which are normally performed by said apparatus.

If the working is satisfactory and shows that the locking of the apparatus on the base has been effected correctly, the guide line 17 may be severed in its lower end portion. This may be performed by means for example of a cutting device 138' located in the passage 18', only the guide-line 17 passing through this cutting device when the apparatus 10' is lowered. The cutting device 138' may be constituted by cutters operated from the surface. The operation of the cutters is remotely controlled by mechanical or electrical means. In this last case, a power line may be lowered together with the depositing tool 27. After severing, the guide-line 17 is lifted and the locking member 13 drops together with the remaining guide line end portion attached thereto. (FIG. 16).

If the locking of the apparatus 10' on the base has not been performed, the guide line 17 is not severed and the apparatus 10' may be lifted along the line 17.

According to a further particular embodiment, the locking member 13' may be provided with holding means for maintaining the shells 32' and 33' in close position with respect to one another. The holding means are remotely controllable as the above described cutting device 138'.

It may happen that the working of the apparatus 10' appears not satisfactory despite a correct connection of connectors 12' and 11*a*. The locking of the member 13' under the base 11, after the member 13' has passed through the passage 15 is postponed until the working of the apparatus 10' has been verified. If the working is satisfactory, the holding means are desactivated so that the locking member 13' expands and the guide line 17 is severed.

Various modifications and additions may of course be made to the embodiment described hereinabove of a method and device according to the invention, without departing from the scope of the invention as defined by the accompanying claims.

In particular, supplementary remotely controllable locking means may be provided for locking the apparatus on its base.

What is claimed is:

1. A method for lifting and returning into position at least one immersed device mounted on a base and equipped with a locating buoy and a guide line wound or folded on itself and connected at one end to the buoy and at its other end to a locking member connected to the base, said method comprising:

releasing said buoy to cause it to rise to the surface and establish said guide line between the base and the surface, lowering a lifting tool along said guide line, separating the immersed device from the base and from said locking member and lifting said immersed device to the surface by means of the lifting tool, providing a device to be returned into immersed position with a fresh buoy, a new locking member and a new guide line connecting said fresh buoy to said new locking member, lowering said device to be returned into immersed position along the established guide line, connecting said new locking member to the base, and severing the previously established guide line.

2. A method as claimed in claim 1, further comprising verifying the working of said device returned into immersed position before severing the previously established guide line.

3. A method as claimed in claim 1, wherein said previously established guide line is severed by severing means actuated when the device to be returned into immersed position is connected to the base.

4. A method as claimed in claim 3, wherein said severing means are actuated by the movement of the device to be lowered into immersed position relative to the base.

5. A method as claimed in claim 4, wherein said severing operation is performed by means of cutters carried by said new locking member and actuated when said new locking member is locked on the base.

6. A method as claimed in claim 1, wherein said device to be returned into immersed position is lowered by introduction of said established guide line provided in this device and said new locking member.

7. A method as claimed in claim 1, wherein said device to be returned into immersed position is automatically oriented with respect to the base by guiding this device on guide means provided on the base during movement of this device relative to the base.

8. A method as claimed in claim 1, wherein said lifting operation is performed by winding a cable with said lifting tool attached at one end thereof and provided with hooking means adapted to be automatically locked on the device to be lifted.

9. A method as claimed in claim 1, wherein said lowering operation of the device to be returned into immersed position is performed by unwinding a cable, with a depositing tool attached at one end thereof and provided with hooking means adapted to be automatically unlocked from the device returned into immersed position.

10. A method as claimed in claim 1, wherein the descending movement of the device to be returned into immersed position is braked when arriving near the base.

11. A device adapted to be immersed and mounted on an underwater base, said device comprising a locating buoy, connecting means for connecting the buoy to the base so as to allow separation thereof by remote control, a guide line folded or wound on itself with a first end connected to the buoy and a second end connected to a locking member connectable to the base and separable from the rest of the device, a passage for guiding the device along a guide line, and severing means disposed in said passage.

12. A device as claimed in claim 11, wherein said locking member is connected to the rest of the device by fitting parallely to said passage in order that said rest of the device may be disconnected from said locking member by pulling parallely to a guide line passing through said passage.

13. A device as claimed in claim 11, wherein said locking member comprises at least two parts which are movable with respect to each other, which delimit a part of said passage for said guide line and which are connected to each other by resilient connecting means, so that said locking member is locked on said base by passing through a passage formed through said base, with the parts of said connecting member being brought close to each other, and subsequent expansion of said connecting member outside said passage formed through said base.

14. A device as claimed in claim 13, wherein said severing means are provided in said connecting member to be actuated when said parts of the connecting member are brought close to each other.

15. A device as claimed in claim 11, further comprising a guide member for cooperating with guide means provided on said base for angularly orienting said device relative to said base when said device reaches said base.

16. A device as claimed in claim 11 further comprising guide means for separating the portion of said guide line extending in said passage between said buoy and said locking member from a further guide line passing through said passage.

* * * * *